US011790838B2

(12) United States Patent
Hashimoto et al.

(10) Patent No.: US 11,790,838 B2
(45) Date of Patent: Oct. 17, 2023

(54) ELECTRONIC DEVICE COMPRISING A NOVEL BIAS CONTROL SIGNAL DRIVER CIRCUIT

(71) Applicant: Innolux Corporation, Miao-Li County (TW)

(72) Inventors: Kazuyuki Hashimoto, Miao-Li County (TW); Yi-Hung Lin, Miao-Li County (TW); Kung-Chen Kuo, Miao-Li County (TW)

(73) Assignee: Innolux Corporation, Miaoli County (TW)

( * ) Notice: Subject to any disclaimer, the term of this patent is extended or adjusted under 35 U.S.C. 154(b) by 0 days.

(21) Appl. No.: 17/947,173

(22) Filed: Sep. 19, 2022

(65) Prior Publication Data

US 2023/0206823 A1 Jun. 29, 2023

Related U.S. Application Data

(60) Provisional application No. 63/293,664, filed on Dec. 24, 2021.

(51) Int. Cl.
*G09G 3/32* (2016.01)

(52) U.S. Cl.
CPC ..... *G09G 3/32* (2013.01); *G09G 2300/0852* (2013.01); *G09G 2300/0861* (2013.01); *G09G 2310/0267* (2013.01); *G09G 2310/06* (2013.01); *G09G 2310/08* (2013.01)

(58) Field of Classification Search
None
See application file for complete search history.

(56) References Cited

U.S. PATENT DOCUMENTS

| | | | | |
|---|---|---|---|---|
| 11,069,292 | B1 * | 7/2021 | Heganovic | G09G 3/3233 |
| 2006/0156121 | A1 * | 7/2006 | Chung | G09G 3/3233 714/726 |
| 2010/0067646 | A1 * | 3/2010 | Liu | G11C 19/28 377/79 |
| 2013/0194248 | A1 * | 8/2013 | Kim | G09G 3/3233 345/212 |
| 2016/0104409 | A1 * | 4/2016 | Jeon | G09G 3/3233 345/690 |
| 2017/0061878 | A1 | 3/2017 | Park et al. | |
| 2017/0323593 | A1 * | 11/2017 | Kim | G11C 19/28 |
| 2020/0202783 | A1 * | 6/2020 | Cheng | H10K 59/1216 |
| 2022/0310003 | A1 * | 9/2022 | Harada | G09G 3/3241 |

OTHER PUBLICATIONS

"Search Report of Europe Counterpart Application", dated Apr. 4, 2023, p. 1-p. 10.

* cited by examiner

*Primary Examiner* — Benjamin C Lee
*Assistant Examiner* — Emily J Frank
(74) *Attorney, Agent, or Firm* — JCIPRNET

(57) ABSTRACT

An electronic device is provided. The electronic device includes a pixel array, a gate driver and a bias control signal driver. The pixel array includes a pixel unit. The gate driver is configured to generate a plurality of gate control signals. The bias control signal driver is electrically connected to the pixel unit and the gate driver. The bias control signal driver is configured to generate a bias signal to drive the pixel unit according to a part of the plurality of gate control signals.

12 Claims, 12 Drawing Sheets

ELECTRONIC DEVICE COMPRISING A NOVEL BIAS CONTROL SIGNAL DRIVER CIRCUIT

CROSS-REFERENCE TO RELATED APPLICATION

This application claims the priority benefit of U.S. provisional application Ser. No. 63/293,664, filed on Dec. 24, 2021. The entirety of the above-mentioned patent application is hereby incorporated by reference herein and made a part of this specification.

BACKGROUND

Technical Field

The disclosure relates a device, particularly, the disclosure relates to an electronic device.

Description of Related Art

In general, a voltage source circuit or a current source circuit need three control signals, for example, a scan signal, a reset signal and a bias signal (or an emission signal), to implement a compensation of a threshold voltage of the voltage source circuit or the current source circuit for a pixel unit in a pixel array of a panel. However, a conventional voltage source circuit or a conventional current source circuit may receive the scan signal and the reset signal from the gate driver integrated circuit (IC), but the bias signal or the emission signal is not provided. Therefore, the conventional voltage source circuit or the conventional current source circuit needs to additionally design a complicated bias signal generation IC to provide the bias signal or the emission signal to the pixel units, thus resulting in an increase in circuit cost.

SUMMARY

The electronic device of the disclosure includes a pixel array, a gate driver and a bias control signal driver. The pixel array includes a pixel unit. The gate driver is configured to generate a plurality of gate control signals. The bias control signal driver is electrically connected to the pixel unit and the gate driver, and configured to generate a bias signal to drive the pixel unit according to a part of the plurality of gate control signals.

Based on the above, according to the electronic device of the disclosure, the electronic device can generate the bias signal to drive the pixel unit according to the part of the plurality of gate control signals without additionally disposing a complicated bias signal generation IC.

To make the aforementioned more comprehensible, several embodiments accompanied with drawings are described in detail as follows.

BRIEF DESCRIPTION OF THE DRAWINGS

The accompanying drawings are included to provide a further understanding of the disclosure, and are incorporated in and constitute a part of this specification. The drawings illustrate exemplary embodiments of the disclosure and, together with the description, serve to explain the principles of the disclosure.

DESCRIPTION OF THE EMBODIMENTS

Figure 1:
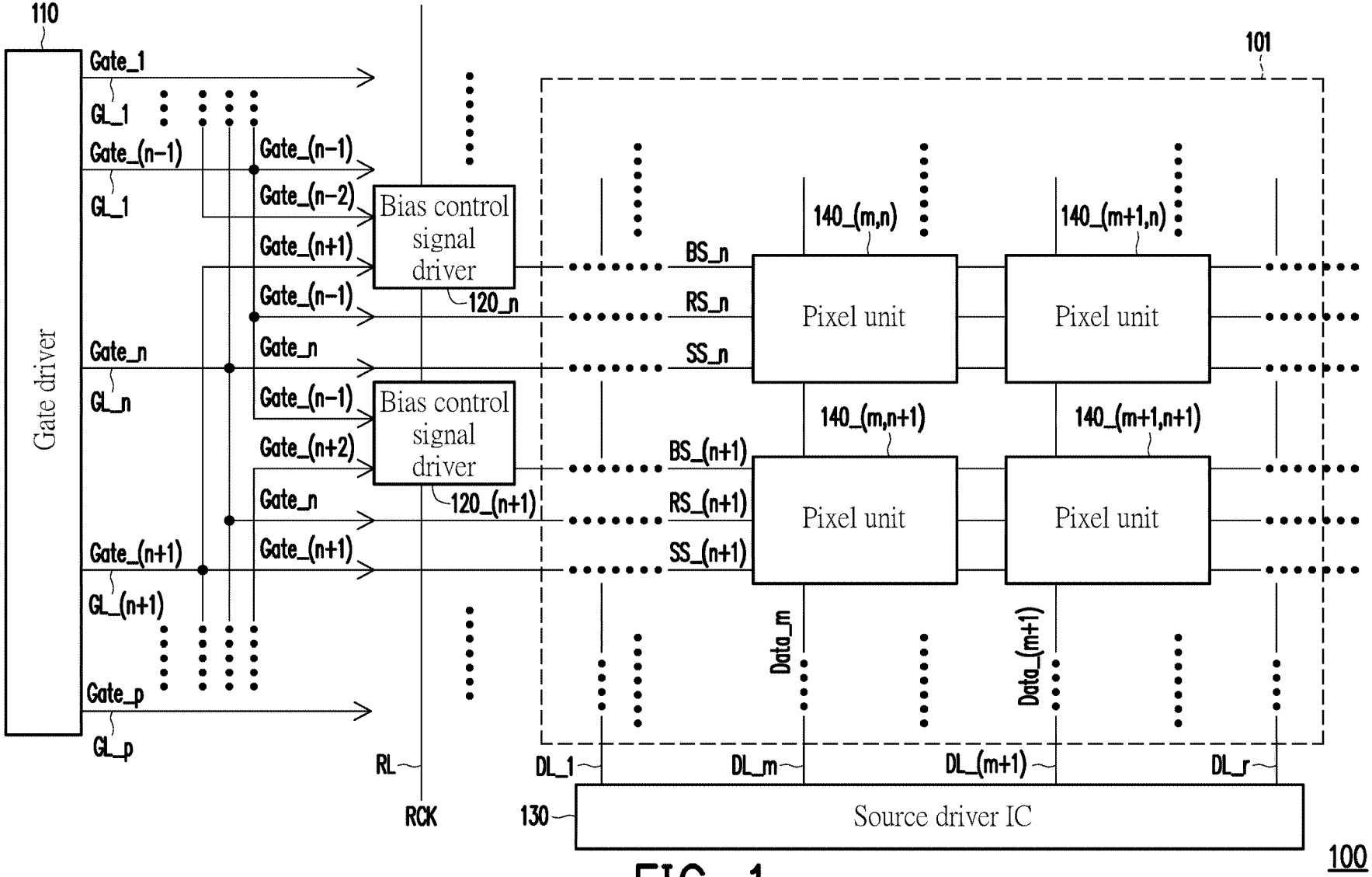
FIG. 1 is a circuit schematic diagram of an electronic device according to an embodiment of the disclosure.

Reference will now be made in detail to the exemplary embodiments of the disclosure, examples of which are illustrated in the accompanying drawings. Whenever possible, the same reference numbers are used in the drawings and the description to refer to the same or like components.

Certain terms are used throughout the specification and appended claims of the disclosure to refer to specific components. Those skilled in the art should understand that electronic device manufacturers may refer to the same components by different names. This article does not intend to distinguish those components with the same function but different names. In the following description and rights request, the words such as "comprise" and "include" are open-ended terms, and should be explained as "including but not limited to . . . ".

The term "coupling (or electrically connection)" used throughout the whole specification of the present application (including the appended claims) may refer to any direct or indirect connection means. For example, if the text describes that a first device is coupled (or connected) to a second device, it should be interpreted that the first device may be directly connected to the second device, or the first device may be indirectly connected through other devices or certain connection means to be connected to the second device. The terms "first", "second", and similar terms mentioned throughout the whole specification of the present application (including the appended claims) are merely used to name discrete elements or to differentiate among different embodiments or ranges. Therefore, the terms should not be regarded as limiting an upper limit or a lower limit of the quantity of the elements and should not be used to limit the arrangement sequence of elements. In addition, wherever possible, elements/components/steps using the same reference numerals in the drawings and the embodiments represent the same or similar parts. Reference may be mutually made to related descriptions of elements/components/steps using the same reference numerals or using the same terms in different embodiments.

The electronic device of the disclosure may include, for example, an active-matrix device for antenna application or display application, and the pixel unit includes an electronic element and a voltage source circuit or a current source circuit. The electronic element of the disclosure may be, for example, a varactor, a light emitting diode, a voltage-controlled element or a current-controlled element. It should be noted that, the electronic device of the disclosure may be manufactured using a display panel process, and related transistors and electronic components are fabricated on a glass substrate. In addition, the first terminal of the transistor may be a drain terminal of the transistor. The second terminal of the transistor may be a source terminal of the transistor. The control terminal of the transistor may be a gate terminal of the transistor.

It should be noted that in the following embodiments, the technical features of several different embodiments may be replaced, recombined, and mixed without departing from the spirit of the disclosure to complete other embodiments. As long as the features of each embodiment do not violate the spirit of the disclosure or conflict with each other, they may be mixed and used together arbitrarily.

FIG. 1 is a circuit schematic diagram of an electronic device according to an embodiment of the disclosure. Referring to FIG. 1, the electronic device 100 includes a pixel array 101, a gate driver 110, a plurality of bias control signal drivers and a source driver integrated circuit (IC) 130. The pixel array 101 includes a plurality of pixel units. The gate driver 110 is electrically connected to the bias control signal drivers through a part of a plurality of gate lines GL_1 to GL_p, and is further electrically connected to pixel units of each row of the pixel array 101 through another part of the gate lines GL_1 to GL_p, where p is a positive integer. Each of the bias control signal drivers is electrically connected to pixel units of each row of the pixel array 101. The source driver IC 130 is electrically connected to pixel units of each column of the pixel array 101 through a plurality of data lines DL_1 to DL_r, where r is a positive integer. In one embodiment, the bias control signal drivers may further be electrically connected to one or more refresh clock signal lines RL to receive one or more refresh clock signals RCK.

In the embodiment of the disclosure, taking the pixel units 140_(m,n), 140_(m+1,n), 140_(m,n+1) and 140_(m+1,n+1) as example, the gate driver 110 is electrically connected to the bias control signal driver 120_*n* and the bias control signal driver 120_(n+1) through the gate lines GL_(n−2), GL_(n−1), GL_(n+1) and GL_(n+2), where n and m are positive integers. The gate driver 110 is electrically connected to the pixel units 140_(m,n), 140_(m+1,n), 140_(m,n+1) and 140_(m+1,n+1) through the gate lines GL_(n−1), GL_(n) and GL_(n+1). The gate lines GL_(n−2) to GL_(n+2) are configured to transmit the gate control signals Gate_(n−2) to Gate_(n+2). The bias control signal driver 120_*n* may generate the bias signal BS_n to the pixel unit 140_(m,n) and the pixel unit 140_(m+1,n) of the n-th row of the pixel array 101 according to the gate control signal Gate_(n−2) and the gate control signal Gate_(n+1). The bias control signal driver 120_(n+1) may generate the bias signal BS (n+1) to the pixel unit 140_(m,n+1) and the pixel unit 140_(m+1,n+1) of the (n+1)-th row of the pixel array 101 according to the gate control signal Gate_(n−1) and the gate control signal Gate_(n+2). The pixel unit 140_(m,n) and the pixel unit 140_(m+1,n) may receive the gate control signal Gate_(n−1), and use the gate control signal Gate_(n−1) as a reset signal RS_n. The pixel unit 140_(m,n) and the pixel unit 140_(m+1,n) may receive the gate control signal Gate_n, and use the gate control signal Gate_n as a scan signal SS_n. The pixel unit 140_(m,n+1) and the pixel unit 140_(m+1,n+1) may receive the gate control signal Gate_n, and use the gate control signal Gate_n as a reset signal RS_(n+1). The pixel unit 140_(m,n+1) and the pixel unit 140_(m+1,n+1) may receive the gate control signal Gate_(n+1), and use the gate control signal Gate_(n+1) as a scan signal SS_(n+1). The pixel unit 140_(m,n) and the pixel unit 140_(m,n+1) may receive the data signal Date_m through the data line DL_m. The pixel unit 140_(m+1,n) and the pixel unit 140_(m+1,n+1) may receive the data signal Date_(m+1) through the data line DL_(m+1).

In the embodiment of the disclosure, the pixel array 101 may be disposed in an active area (AA), and the gate driver 110, the bias control signal drivers and the source driver IC 130 may be disposed in a surrounding area. The surrounding area may surround the active area.

Figure 2:
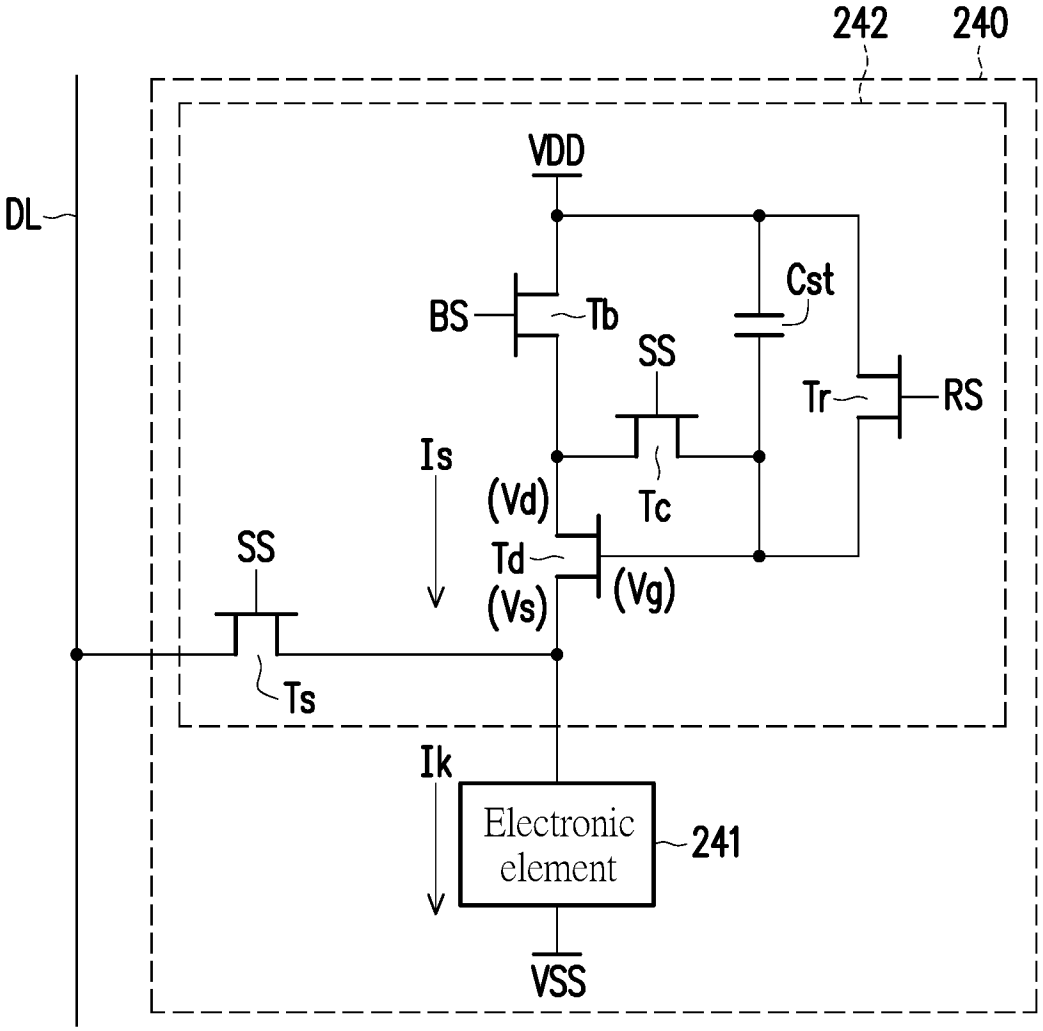
FIG. 2 is a circuit schematic diagram of a pixel unit according to an embodiment of the disclosure.

FIG. 2 is a circuit schematic diagram of a pixel unit according to an embodiment of the disclosure. Referring to FIG. 2, each pixel unit of the disclosure may be implemented as a pixel unit 240 of FIG. 2. The pixel unit 240 includes an electronic element 241 and a voltage source circuit 242. The voltage source circuit 242 is configured to provide a source current Is to the electronic element 241, and the electronic element 241 may generate a leak current Ik. The voltage source circuit 242 includes a driver transistor Td, a scan transistor Ts, a compensation transistor Tc, a bias transistor Tb, a reset transistor Tr and a storage capacitor Cst.

In the embodiment of the disclosure, a first terminal of the scan transistor Ts is electrically connected to a data line DL. A second terminal of the scan transistor Ts is electrically connected to the electronic element 241 and the driver transistor Td. A control terminal of the scan transistor Ts receives a scan signal SS. A first terminal of the driver transistor Td is electrically connected to the bias transistor Tb and the compensation transistor Tc. A second terminal of the driver transistor Td is electrically connected to the electronic element 241 and the second terminal of the scan transistor Ts. A control terminal of the driver transistor Td is electrically connected to the compensation transistor Tc, the reset transistor Tr and the storage capacitor Cst. A first terminal of the bias transistor Tb is electrically connected to a first operation voltage VDD. A second terminal of the bias transistor Tb is electrically connected to the first terminal of the driver transistor Td and the compensation transistor Tc. A control terminal of the bias transistor Tb receives a bias signal BS. A first terminal of the compensation transistor Tc is electrically connected to the first terminal of the driver transistor Td and the second terminal of the bias transistor Tb. A second terminal of the compensation transistor Tc is electrically connected to the control terminal of the driver transistor Td, the storage capacitor Cst and the reset transistor Tr. A control terminal of the compensation transistor Tc receives the scan signal SS. A first terminal of the capacitor Cst is electrically connected to the first operation voltage VDD and the reset transistor Tr. A second terminal of the capacitor Cst is electrically connected to the control terminal of the driver transistor Td, the second terminal of the compensation transistor Tc and the reset transistor Tr. A first terminal of the reset transistor Tr is electrically connected to the first operation voltage VDD. A second terminal of the reset transistor Tr is electrically connected to the control terminal of the driver transistor Td, the storage capacitor Cst and the second terminal of the compensation transistor Tc. A control terminal of the reset transistor Tr receives a reset signal RS. The electronic element 241 is electrically connected between the voltage source circuit 242 and a second operation voltage VSS. In the embodiment of the disclosure, the driver transistor Td, the scan transistor Ts, the compensation transistor Tc, the bias transistor Tb and the reset transistor Tr may be a n-type transistor (e.g., Thin-Film Transistor (TFT)), respectively. In the embodiment of the disclosure, the first operation voltage VDD may be greater than the second operation voltage VSS, but the disclosure is not limited thereto. In one embodiment of the disclosure, the driver transistor Td may also be a p-type transistor, and the second operation voltage VSS may be greater than the first operation voltage VDD.

Figure 3:
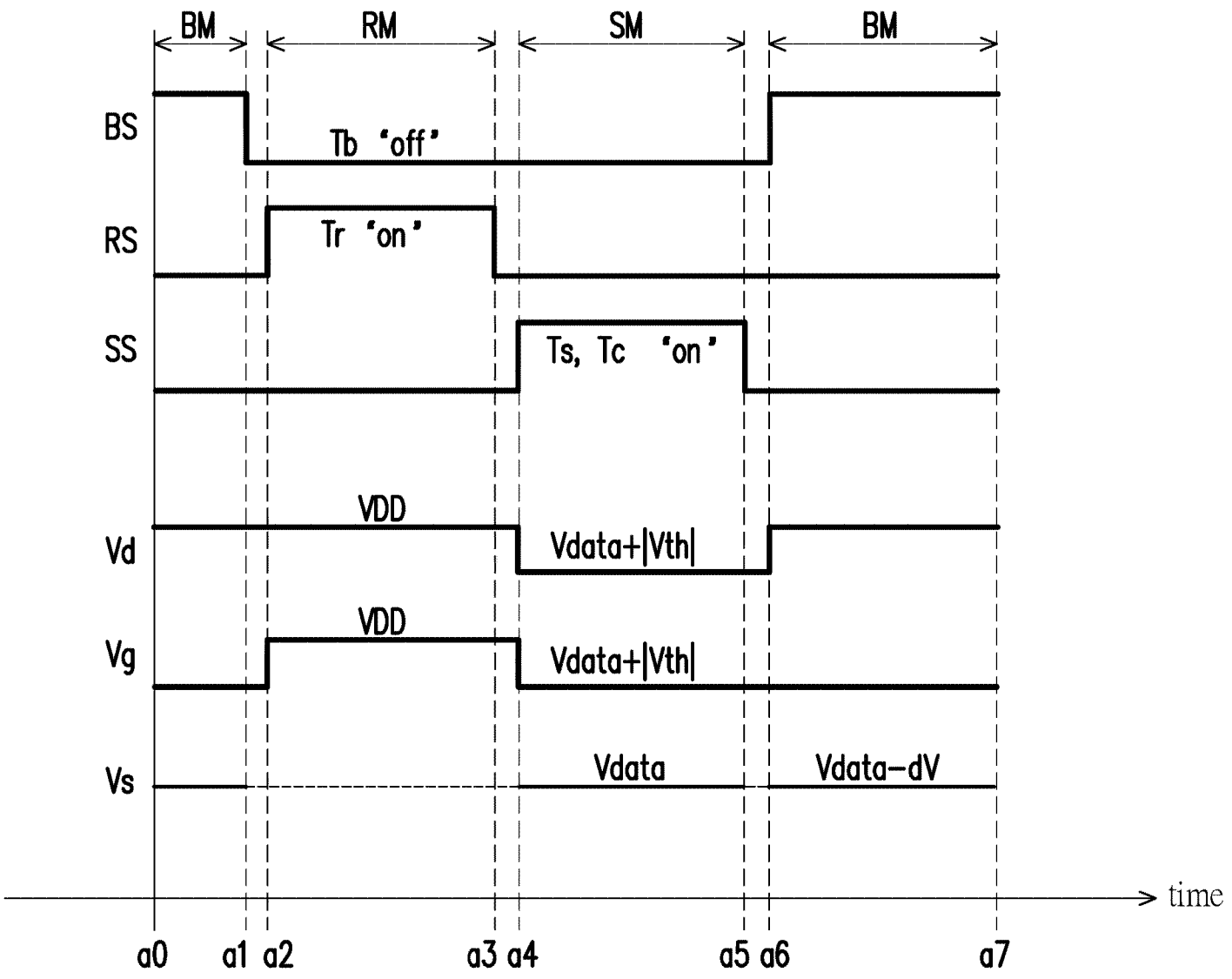
FIG. 3 is an operation timing diagram of the pixel unit according to the embodiment of FIG. 2 of the disclosure.

FIG. 3 is an operation timing diagram of the pixel unit according to the embodiment of FIG. 2 of the disclosure. Referring to FIG. 2 and FIG. 3, the pixel unit 240 may be operated in a bias period BM, a reset period RM and a scan period SM according to the bias signal BS, the reset signal RS and the scan signal SS. During the reset period RM from time a2 to time a3, the reset signal RS may be a high voltage level, and the bias signal BS and the scan signal SS may be a low voltage level. The reset transistor Tr is turned-on, and the other transistors are turned-off. The voltage Vd of the first terminal and the voltage Vg of the control terminal of the driver transistor Td may equal to the first operation voltage VDD. During the scan period SM from time a4 to time a5, the scan signal SS may be the high voltage level, and the bias signal BS and the reset signal RS may be the low voltage level. The scan transistor Ts and the compensation transistor Tc are turned-on, and the other transistors are turned-off. The scan transistor Ts may provide the data signal with a data voltage Vdata to the second terminal of the driver transistor Td. Thus, the voltage Vs of the second terminal of the driver transistor Td may equal to the data voltage Vdata. The voltage Vd of the first terminal and the voltage Vg of the control terminal of the driver transistor Td may equal to the voltage of the data voltage Vdata plus threshold voltage |Vth| of the driver transistor Td. During the bias period BM from time a0 to time a1 and time a6 to time a7, the bias signal BS may be a high voltage level, and the reset signal RS and the scan signal SS may be a low voltage level. The voltage Vd of the first terminal of the driver transistor Td may be set to the first operation voltage VDD, and the voltage Vg of the control terminal of the driver transistor Td may hold at the voltage of the data voltage Vdata plus threshold voltage |Vth| of the driver transistor Td by the storage capacitor Cst. Thus, the voltage Vs of the second terminal of the driver transistor Td may be the voltage of the data voltage Vdata minus a delta voltage dV caused by the source current Is for compensating the leak current Ik. Therefore, the electronic element 241 may be driven efficiently and stably.

Figure 4:
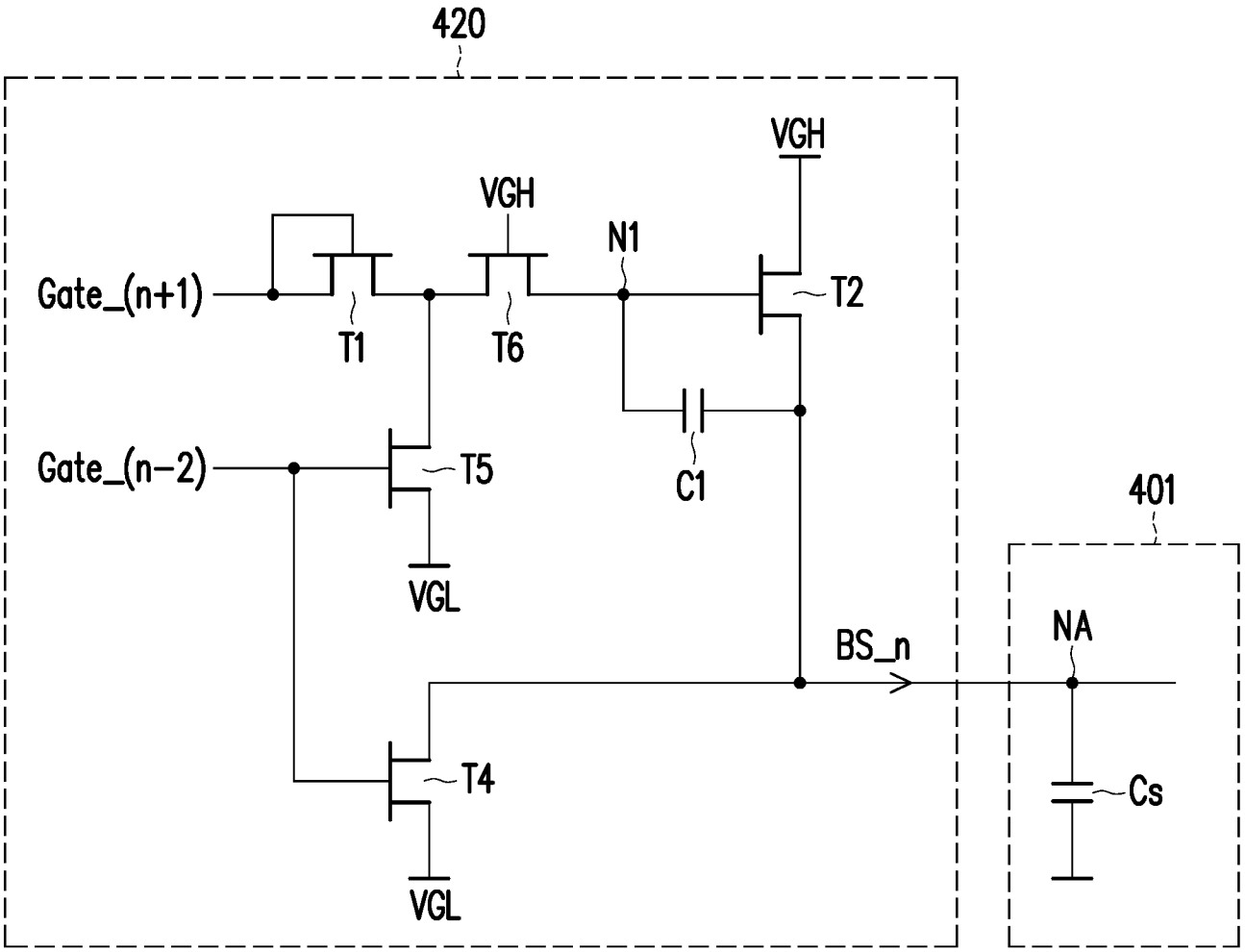
FIG. 4 is a circuit schematic diagram of a bias control signal driver according to an embodiment of the disclosure.

FIG. 4 is a circuit schematic diagram of a bias control signal driver according to an embodiment of the disclosure. Referring to FIG. 1 and FIG. 4, each bias control signal driver of the disclosure may be implemented as a bias control signal driver 420 of FIG. 4, and the pixel units of n-th row of pixel array 101 of FIG. 1 and the related circuit units disposed on the line and electrically connected to the pixel units may equivalent to an equivalent circuit 401 with a stray (parasitic) capacitance Cs. For example, the circuit node NA may electrically connect to the control terminal of the bias transistor Tb as the shown in FIG. 2. The bias control signal driver 420 may provide the bias signal BS_n to the bias transistor Tb of the voltage source circuit 242.

In the embodiment of disclosure, the bias control signal driver 420 includes a plurality of transistors T1, T2, T4, T5, T6 and capacitor C1. A first terminal of the transistor T1 (that is, the first transistor recited in claim) is electrically connected to the gate line GL_(n+1) to receive the gate control signal Gate_(n+1). A second terminal of the transistor T1 is electrically connected to the transistor T5 (that is, the fifth transistor recited in claim) and the transistor T6 (that is, the sixth transistor recited in claim). A control terminal of the transistor T1 is electrically connected to the first terminal of the transistor T1. A first terminal of the transistor T6 is electrically connected to the second terminal of the transistor T1 and the transistor T5. A second terminal of the transistor T6 is electrically connected to the transistor T2 (that is, the second transistor recited in claim) and the capacitor C1 through a circuit node N1. A control terminal of the transistor T6 is electrically connected to a voltage VGH. A first terminal of the transistor T2 is electrically connected to the voltage VGH. A second terminal of the transistor T2 is electrically connected to the capacitor C1, the transistor T4 (that is, the fourth transistor recited in claim) and circuit node NA. A control terminal of the transistor T2 is electrically connected to the second terminal of the transistor T6 and the capacitor C1 through the circuit node N1. A first terminal of the transistor T5 is electrically connected to the second terminal of the transistor T1 and the first terminal of the transistor T6. A second terminal of the transistor T5 is electrically connected to a voltage VGL. A control terminal of the transistor T5 is electrically connected to the gate line GL_(n−2) to receive the gate control signal Gate_(n−2). A first terminal of the transistor T4 is electrically connected to the second terminal of the transistor T2, the capacitor C1 and the circuit node NA. A second terminal of the transistor T4 is electrically connected to the voltage VGL. A control terminal of the transistor T4 is electrically connected to the gate line GL_(n−2) to receive the gate control signal Gate_(n−2). In the embodiment of the disclosure, the transistors T1, T2, T4, T5 and T6 may be a n-type transistor, respectively. The voltage VGH may be greater than the voltage VGL, but the disclosure is not limited thereto. In the embodiment of the disclosure, the voltage VGH and the voltage VGL correspond to the high voltage level and the low voltage level of operation diagram of the bias signal BS, the reset signal RS and the scan signal SS in FIG. 3, respectively.

In addition, in one embodiment of the disclosure, the first terminal of the transistor T1 may electrically connected to the voltage VGH. The second terminal of the transistor T1 may still electrically connected to the transistor T5 and the transistor T6. The control terminal of the transistor T1 may be electrically connected to the gate line GL_(n+1) to receive the gate control signal Gate_(n+1).

Figure 5:
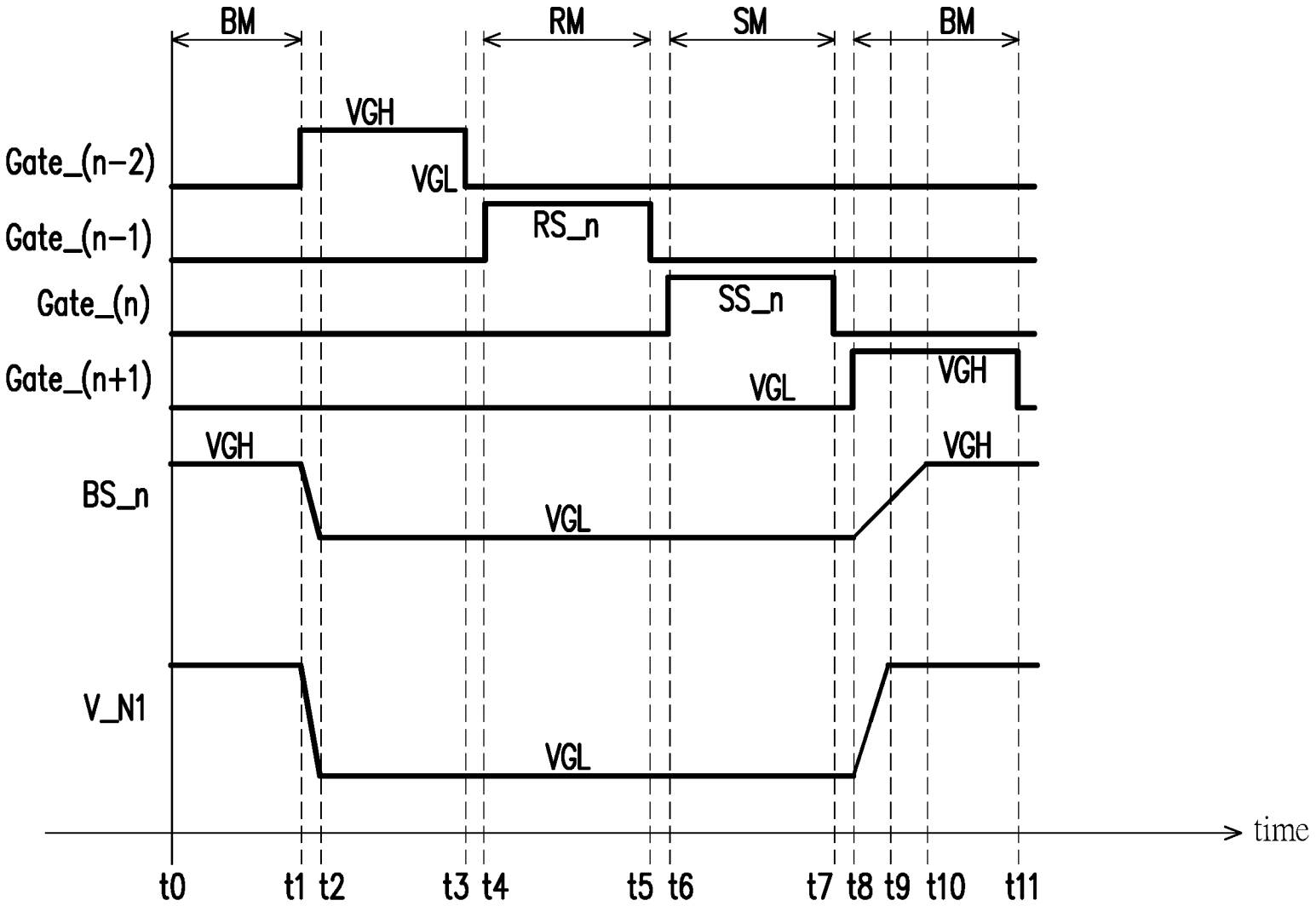
FIG. 5 is an operation timing diagram of the bias control signal driver according to the embodiment of FIG. 4 of the disclosure.

FIG. 5 is an operation timing diagram of the bias control signal driver according to the embodiment of FIG. 4 of the disclosure. Referring to FIG. 1, FIG. 4 and FIG. 5, the bias control signal driver 420 may be operated as the timing of FIG. 5. During the period from time t1 to time t3, the gate control signal Gate_(n−2) changes from the voltage VGL to the voltage VGH, the gate control signal Gate_(n+1) may be the voltage VGL, and the gate control signal Gate_(n−1) and the gate control signal Gate_(n) may be the voltage VGL. The transistors T4, T5 and T6 are turned-on, and the transistor T1 is turned-off. The transistor T5 may change the voltage V_N1 of the circuit node N1 to the voltage VGL through the transistor T6, and then the transistor T2 is turned-off by the voltage V_N1 of the circuit node N1. Thus, the transistor T4 may change the voltage of the bias signal BS_n from the voltage VGH to the voltage VGL during the period from time t1 to time t2, so as to reset the bias signal BS_n. The circuit node NA may have the voltage VGL, so that, for example, the bias transistor Tb of FIG. 2 may be turned-off.

During the reset period RM of the pixel unit from time t4 to time t5, the gate control signal Gate_(n−1) transmitted by the gate line GL_(n−1) changes from the voltage VGL to the voltage VGH as the reset signal RS_n, and the voltage levels of the gate control signals Gate_(n−2), Gate_n and Gate_(n+1) maybe the voltage VGL. Thus, the pixel unit may receive the reset signal RS_n with the voltage VGH, and, for example, the bias transistor Tb of FIG. 2 may still be turned-off, and the reset transistor Tr of FIG. 2 may be turned-on.

During the scan period SM of the pixel unit from time t6 to time t7, the gate control signal Gate_n transmitted by the gate line GL_n changes from the voltage VGL to the voltage VGH as the scan signal SS_n, and the voltage levels of the gate control signals Gate_(n−2), Gate_(n−1) and Gate_(n+1) may be the voltage VGL. Thus, the pixel unit may receive the scan signal SS_n with the voltage VGH, and, for example, the bias transistor Tb of FIG. 2 may still be turned-off, and the scan transistor Ts and the compensation transistor Tc of FIG. 2 may be turned-on.

During the bias period BM of the pixel unit after time t8 or before time t1, the gate control signal Gate_(n+1) transmitted by the gate line GL_(n+1) changes from the voltage VGL to the voltage VGH during period from t8 to time t11, and the voltage levels of the gate control signals Gate_(n−2), Gate_(n−1) and Gate_(n) may be the voltage VGL. The transistors T1, T2 and T6 are turned-on, and other transistors are turned-off. Thus, during the period from time t8 to time t9, the voltage V_N1 of the circuit node N1 may be firstly changed to the voltage of the voltage VGH minus the threshold voltage |Vth1| of the transistor T1 by the transistor T1 through the transistor T6, and then the transistor T2 may be turned-on. Thus, the voltage of the bias signal BS_n may rise from the voltage VGL, and then the voltage V_N1 of the circuit node N1 may be changed to a higher voltage than the voltage VGH by the coupling of the capacitor C1 (bootstrap), so that the transistor T1 and the transistor T6 may be cut-off. The transistor T2 may be fully turned-on after time t9, and the voltage of the bias signal BS_n may reach the voltage VGH and keep after time t10. Therefore, the bias control signal driver 420 may effectively provide the bias signal BS_n to the pixel units of n-th row of pixel array 101 of FIG. 1 according to the gate control signal Gate_(n+1) and the gate control signal Gate_(n−2). Thus, for example, the bias transistor Tb of FIG. 2 may receive the bias signal BS_n, and the voltage source circuit 242 may implement the compensation of the threshold voltage of the driving voltage for the driving electronic element 241 according to the bias signal BS, the scan signal SS and the reset signal RS.

Figure 6:
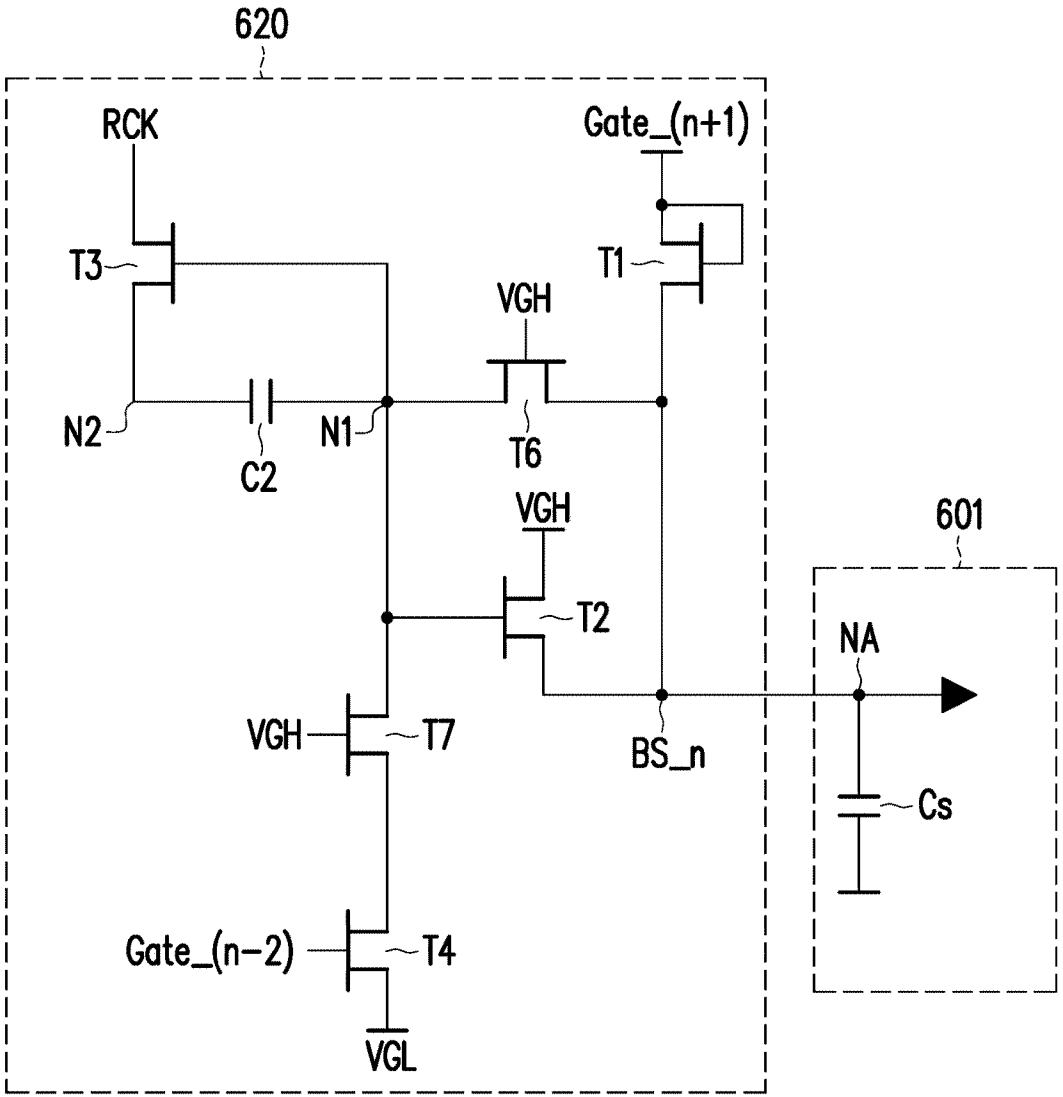
FIG. 6 is a circuit schematic diagram of a bias control signal driver according to an embodiment of the disclosure.

FIG. 6 is a circuit schematic diagram of a bias control signal driver according to an embodiment of the disclosure. Referring to FIG. 1 and FIG. 6, each bias control signal driver of the disclosure may be implemented as a bias control signal driver 620 of FIG. 6, and the pixel units of n-th row of pixel array 101 of FIG. 1 and the related circuit units disposed on the line and electrically connected to the pixel units may equivalent to an equivalent circuit 601 with a stray (parasitic) capacitance Cs. For example, the circuit node NA may electrically connect to the control terminal of the bias transistor Tb as the shown in FIG. 2. The bias control signal driver 620 may provide the bias signal BS_n to the bias transistor Tb of the voltage source circuit 242.

In the embodiment of disclosure, the bias control signal driver 620 includes transistors T1, T2, T3, T4, T6, T7 and capacitor C2. A first terminal of the transistor T1 (that is, the first transistor recited in claim) is electrically connected to the gate line GL_(n+1) to receive the gate control signal Gate_(n+1). A second terminal of the transistor T1 is electrically connected to the transistor T2 (that is, the second transistor recited in claim), the transistor T6 (that is, the sixth transistor recited in claim) and the circuit node NA. A control terminal of the transistor T1 is electrically connected to the first terminal of the transistor T1. A first terminal of the transistor T6 is electrically connected to the second terminal of the transistor T1, the transistor T2 and the circuit node NA. A second terminal of the transistor T6 is electrically connected to the transistor T2, the transistor T7 (that is, the seventh transistor recited in claim) and the capacitor C2 through a circuit node N1. A control terminal of the transistor T6 is electrically connected to a voltage VGH. A first terminal of the transistor T2 is electrically connected to the voltage VGH. A second terminal of the transistor T2 is electrically connected to the second terminal of the transistor T1, the first terminal of the transistor T6 and circuit node NA. A control terminal of the transistor T2 is electrically connected to the second terminal of the transistor T6, the transistor T3 (that is, the third transistor recited in claim) and the capacitor C2 through the circuit node N1, and electrically connected to the transistor T7. A first terminal of the transistor T3 receives a refresh clock signal RCK. A second terminal of the transistor T3 is electrically connected to a first terminal of the capacitor C2 through a circuit node N2. A control terminal of the transistor T3 is electrically connected to a second terminal of the capacitor C2, the second terminal of transistor T6, the control terminal of transistor T2 and first terminal of the transistor T7 through the circuit node N1. A first terminal of the transistor T7 is electrically connected to the control terminal of the transistor T3, the second terminal of the transistor T6, the control terminal of the transistor T2 and the capacitor C2 through the circuit node N1. A second terminal of the transistor T7 is electrically connected to the transistor T4. A control terminal of the transistor T7 is electrically connected to the voltage VGH. A first terminal of the transistor T4 (that is, the fourth transistor recited in claim) is electrically connected to the second terminal of the transistor T7. A second terminal of the transistor T4 is electrically connected to the voltage VGL. A control terminal of the transistor T4 is electrically connected to the gate line GL_(n−2) to receive the gate control signal Gate_(n−2). In the embodiment of the disclosure, the transistors T1, T2, T3, T4, T6 and T7 may be an n-type transistor, respectively. In the embodiment of the disclosure, the voltage VGH may be greater than the voltage VGL, but the disclosure is not limited thereto. The voltage VGH and the voltage VGL correspond to the high voltage level and the low voltage level of operation diagram of the bias signal BS, the reset signal RS and the scan signal SS in FIG. 3, respectively.

In addition, in one embodiment of the disclosure, the first terminal of the transistor T1 may electrically connected to the voltage VGH. The second terminal of the transistor T1 may still electrically connected to the transistor T2, the transistor T6 and the circuit node NA. The control terminal of the transistor T1 may electrically connected to the gate control signal Gate_(n+1).

Figure 7:
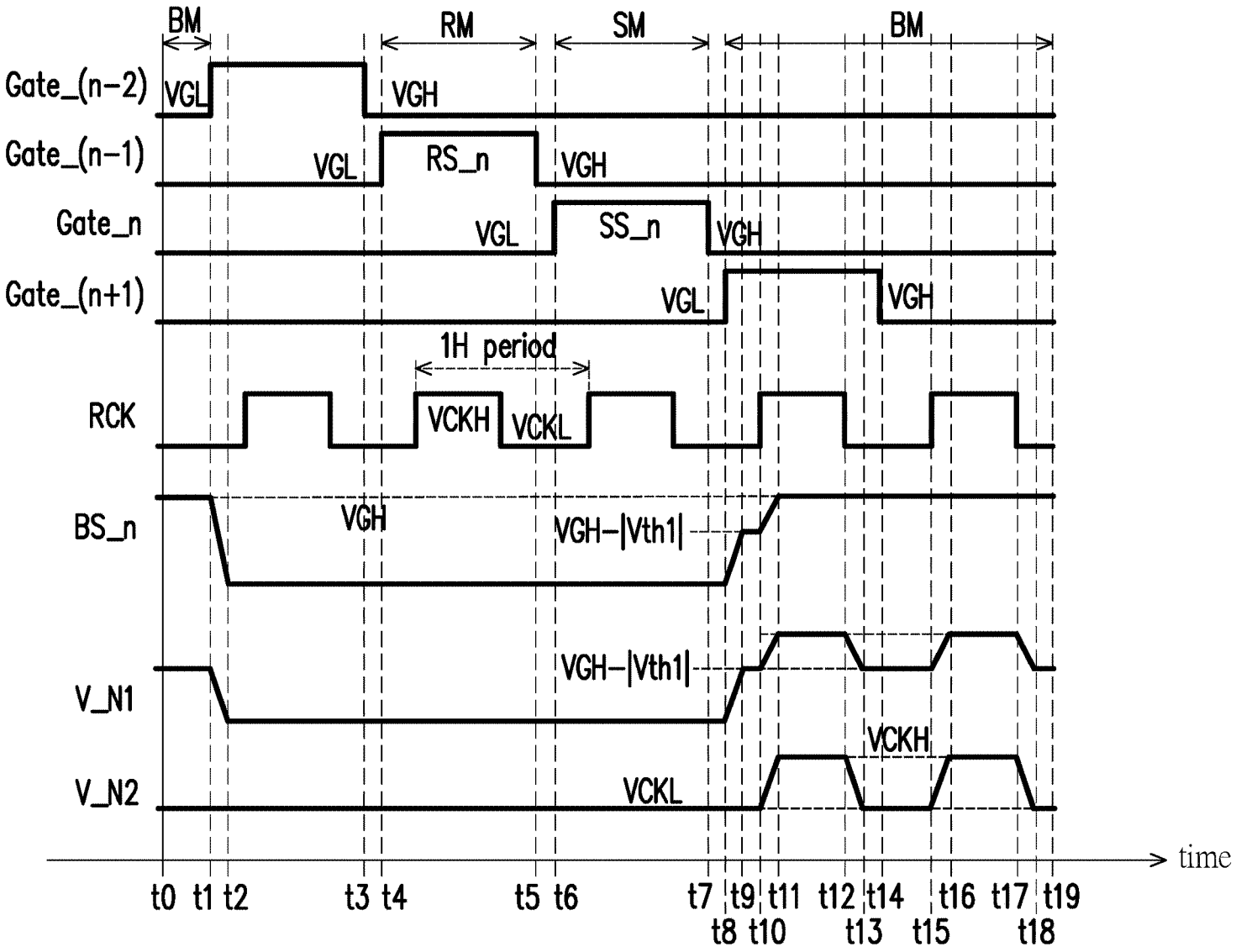
FIG. 7 is an operation timing diagram of the bias control signal driver according to the embodiment of FIG. 6 of the disclosure.

FIG. 7 is an operation timing diagram of the bias control signal driver according to the embodiment of FIG. 6 of the disclosure. Referring to FIG. 1, FIG. 6 and FIG. 7, the bias control signal driver 620 may be operated as the operation timing diagram of FIG. 7. In the embodiment, the waveform of the refresh clock signal RCK changes periodically during the period from t0 to time t19, and the time length of one horizontal period (1H period) of the panel may be equal to the time length of one low voltage level waveform and one high voltage level waveform. During the period from time t1 to time t3, the gate control signal Gate_(n−2) changes from the voltage VGL to the voltage VGH, the gate control signal Gate_(n+1) may be the voltage VGL, and the gate control signal Gate_(n−1) and the gate control signal Gate_(n) may be the voltage VGL. The transistors T4, T6 and T7 are turned-on, and other transistors are turned-off. Thus, during the period from time t1 to time t2, the transistor T4 may change the voltage V_N1 of the circuit node N1 to the voltage VGL through the transistor T7, and then the transistor T2 may be turned-off. The transistor T4 may change voltage of the bias signal BS_n from the voltage VGH to the voltage VGL through the transistor T6 and the transistor T7, so as to reset the bias signal BS_n. The circuit node NA may have the voltage VGL, so that, for example, the bias transistor Tb of FIG. 2 may be turned-off.

During the reset period RM of the pixel unit from time t4 to time t5, the gate control signal Gate_(n−1) transmitted by the gate line GL_(n−1) changes from the voltage VGL to the voltage VGH as the reset signal RS_n, and the voltage levels of the gate control signals Gate_(n−2), Gate_n and Gate_(n+1) maybe the low voltage level. Thus, the pixel unit may receive the reset signal RS_n with the high voltage level, and, for example, the bias transistor Tb of FIG. 2 may still be turned-off and the reset transistor Tr may be turned-on.

During the scan period SM of the pixel unit from time t6 to time t7, the gate control signal Gate_n transmitted by the gate line GL_n changes from the voltage VGL to the voltage VGH as the scan signal SS_n, and the voltage levels of the gate control signals Gate_(n−2), Gate_(n−1) and Gate_(n+1) may be the voltage VGL. Thus, the pixel unit may receive the scan signal SS_n with the high voltage level, and, for example, the bias transistor Tb of FIG. 2 may still be turned-off, and the scan transistor Ts and the compensation transistor Tc may be turned-on.

During the bias period BM of the pixel unit after time t8 or before time t1, the gate control signal Gate_(n+1) transmitted by the gate line GL_(n+1) changes from the voltage VGL to the voltage VGH during the period from time t8 to time t11, and the voltage levels of the gate control signals Gate_(n−2), Gate_(n−1) and Gate_n may be the voltage VGL. The transistors T1 to T3, T6 and T7 are turned-on, and the transistor T4 is turned-off. Thus, during the period from time t8 to time t9, if the voltage of the refresh clock signal RCK is the low voltage level VCKL, the voltage V_N1 of the circuit node N1 may be first changed to the voltage of the voltage VGH minus the threshold voltage |Vth1| of the transistor T1 by the transistor T1 through the transistor T6. During the period from time t9 to time t10, if the voltage of the refresh clock signal RCK is still the low voltage level VCKL, the voltage V_N1 of the circuit node N1 may be maintained at the voltage of the voltage VGH minus the threshold voltage |Vth| of the transistor T1.

During the period from time t10 to time t11, if the voltage of the refresh clock signal RCK changes to the high voltage level VCKH, the voltage of the circuit node N2 may be changed from the low voltage level VCKL to the high voltage level VCKH by the refresh clock signal RCK through the transistor T3. Thus, the voltage V_N1 of the circuit node N1 may be changed by the coupling of the capacitor C2 from the voltage of the voltage VGH minus the threshold voltage |Vth1| of the transistor T1 to the voltage of the voltage VGH minus the threshold voltage |Vth1| of the transistor T1 and plus a voltage dV, so that the transistor T6 and the transistor T7 may be cut-off. The voltage dV is determined by the capacitor C2, the voltage difference level of the high voltage level VCKH minus the low voltage level VCKL and the transistor T2. The transistor T2 may be fully turned-on, and then the voltage of the bias signal BS_n may be boosted from the voltage of the voltage VGH minus the threshold voltage |Vth1| of the transistor T1 to the voltage VGH by the refresh clock signal RCK through the transistor T3 and the capacitor C2. The circuit node NA may have the voltage VGH, so that, for example, the bias transistor Tb of FIG. 2 may be turned-on.

During the period from time t11 to time t12, if the voltage of the refresh clock signal RCK is maintain at the high voltage level VCKH, the voltage V_N1 of the circuit node N1 and the voltage V_N2 of the circuit node N2 may also be maintained. Thus, the voltage of the bias signal BS_n reaches to the voltage VGH may also be maintained at the voltage VGH.

During the period from time t12 to time t13, if the voltage of the refresh clock signal RCK is changed to the low voltage level VCKL, the voltage V_N2 of the circuit node N2 is changed from the high voltage level VCKH to the low voltage level VCKL by the refresh clock signal RCK through the transistor T3. The voltage V_N1 of the circuit node N1 may change to the voltage of the voltage VGH minus the threshold voltage |Vth1| of the transistor T1 by the capacitive coupling of the capacitor C2, so that the transistor T2 and the transistor T3 are cut-off, but the voltage of the bias signal BS_n may keep at the voltage VGH by the stray (parasitic) capacitance Cs.

During the period from time t13 to time t19, just toggling the refresh clock signal RCK, the transistor T2 and the transistor T3 will be turned-on again, so as to refresh the voltage of the bias signal BS_n with the voltage VGH. In other words, during the bias period BM of the pixel unit, the transistor T2 and the transistor T3 may be turned-on and turned-off periodically to effectively reduce the stress of the transistor T2 and the transistor T3, and the bias signal BS_n may be maintained at the voltage VGH. Therefore, the bias control signal driver 620 may effectively provide the bias signal BS_n to the pixel units of n-th row of pixel array 101 of FIG. 1 according to the gate control signal Gate_(n+1) and the gate control signal Gate_(n−2). Thus, for example, the bias transistor Tb of FIG. 2 may receive the bias signal BS_n, and the voltage source circuit 242 may implement the compensation of the threshold voltage of the driving voltage for the driving electronic element 241 according to bias signal BS, the scan signal SS and the reset signal RS.

Figure 8:
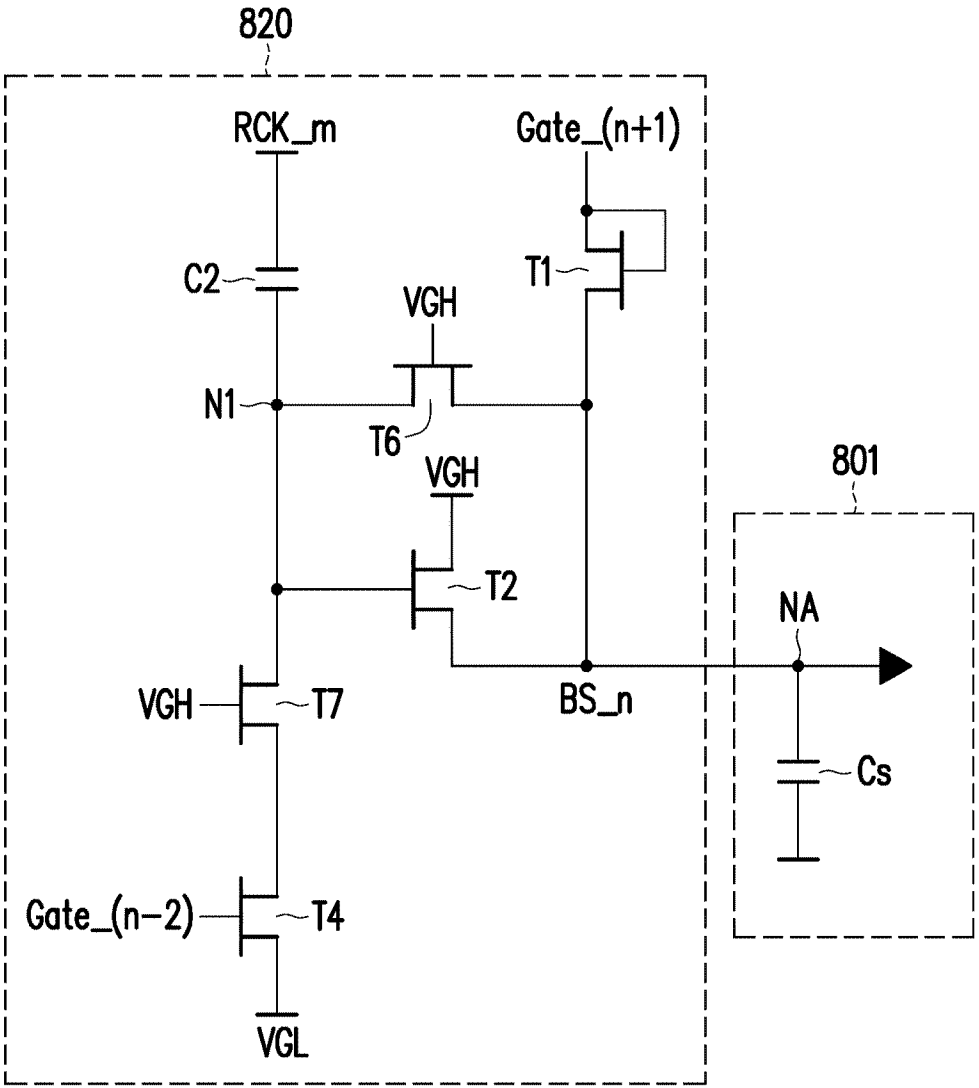
FIG. 8 is a circuit schematic diagram of a bias control signal driver according to an embodiment of the disclosure.

FIG. 8 is a circuit schematic diagram of a bias control signal driver according to an embodiment of the disclosure. Referring to FIG. 1 and FIG. 8, each bias control signal driver of the disclosure may be implemented as a bias control signal driver 820 of FIG. 8, and the pixel units of n-th row of pixel array 101 of FIG. 1 and the related circuit units disposed on the line and electrically connected to the pixel units may equivalent to an equivalent circuit 801 with a stray (parasitic) capacitance Cs. For example, the circuit node NA may electrically connect to the control terminal of the bias transistor Tb as the shown in FIG. 2. The bias control signal driver 820 may provide the bias signal BS_n to the bias transistor Tb of the voltage source circuit 242.

In the embodiment of disclosure, the bias control signal driver 820 includes transistors T1, T2, T4, T6, T7 and capacitor C2. A first terminal of the transistor T1 (that is, the first transistor recited in claim) is electrically connected to the gate line GL_(n+1) to receive the gate control signal Gate_(n+1). A second terminal of the transistor T1 is electrically connected to the transistor T2 (that is, the second transistor recited in claim), the transistor T6 (that is, the sixth transistor recited in claim) and the circuit node NA. A control terminal of the transistor T1 is electrically connected to the first terminal of the transistor T1. A first terminal of the transistor T6 is electrically connected to the second terminal of the transistor T1, the transistor T2 and the circuit node NA. A second terminal of the transistor T6 is electrically connected to the transistor T2, the transistor T7 (that is, the seventh transistor recited in claim) and the capacitor C2 through a circuit node N1. A control terminal of the transistor T6 is electrically connected to a voltage VGH. A first terminal of the transistor T2 is electrically connected to the voltage VGH. A second terminal of the transistor T2 is electrically connected to the second terminal of the transistor T1, the first terminal of the transistor T6 and circuit node NA. A control terminal of the transistor T2 is electrically connected to the second terminal of the transistor T6, and the capacitor C2 through the circuit node N1, and electrically connected to the transistor T7. A first terminal of the transistor T7 is electrically connected to the second terminal of the transistor T6 and the capacitor C2 through the circuit node N1, and is electrically connected to the control terminal of the transistor T2. A second terminal of the transistor T7 is electrically connected to the transistor T4. A control terminal of the transistor T7 is electrically connected to the voltage VGH. A first terminal of the transistor T4 (that is, the fourth transistor recited in claim) is electrically connected to the second terminal of the transistor T7. A second terminal of the transistor T4 is electrically connected to the voltage VGL. A control terminal of the transistor T4 is electrically connected to the gate line GL_(n−2) to receive the gate control signal Gate_(n−2). A first terminal of the capacitor C2 receives an m-th refresh clock signal RCK_m. A second terminal of the capacitor C2 is electrically connected to the second terminal of the transistor T6, the control terminal of the transistor T2 and the first terminal of the transistor T7 through the circuit node N1. In the embodiment of the disclosure, the transistors T1, T2, T4, T6 and T7 may be a n-type transistor, respectively. The voltage VGH may be greater than the voltage VGL, but the disclosure is not limited thereto. In the embodiment of the disclosure, the voltage VGH and the voltage VGL correspond to the high voltage level and the low voltage level of operation diagram of the bias signal BS, the reset signal RS and the scan signal SS in FIG. 3, respectively.

In addition, in one embodiment of the disclosure, the first terminal of the transistor T1 may electrically connected to the voltage VGH. The second terminal of the transistor T1 may still electrically connected to the transistor T2, the transistor T6 and the circuit node NA. The control terminal of the transistor T1 may receive the gate control signal Gate_(n+1).

Figure 9:
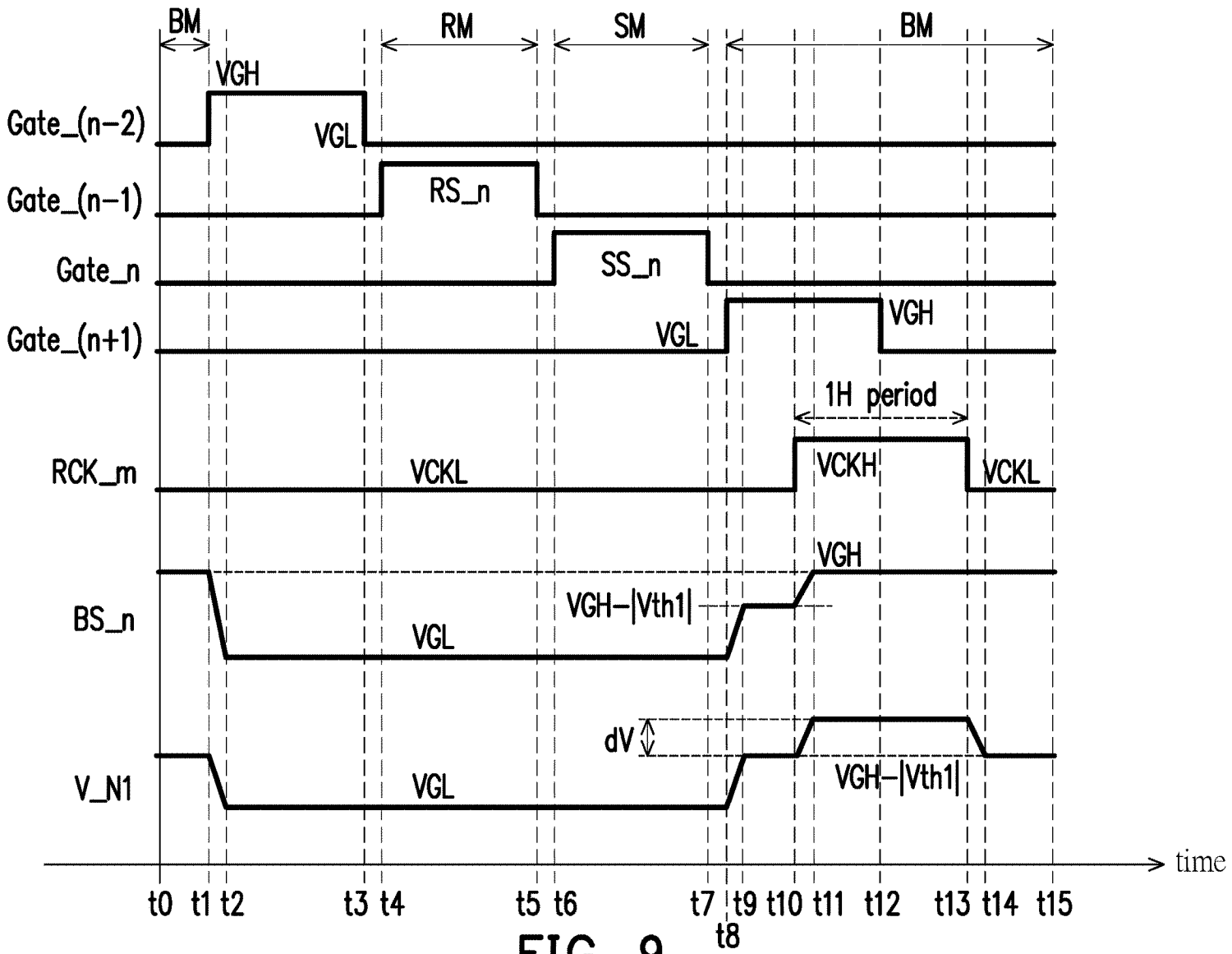
FIG. 9 is an operation timing diagram of the bias control signal driver according to the embodiment of FIG. 8 of the disclosure.

FIG. 9 is an operation timing diagram of the bias control signal driver according to the embodiment of FIG. 8 of the disclosure. Referring to FIG. 1, FIG. 8 and FIG. 9, the bias control signal driver 820 may be operated as the timing of FIG. 8. In the embodiment, the waveform of the refresh clock signal RCK_m changes from the low voltage level VCKL to the high voltage level VCKH only during the period from time t10 to time t13, and the time length of one horizontal period (1H period) of the panel may be equal to the time length of one high voltage level waveform. During the period from time t1 to time t3, the gate control signal Gate_(n−2) changes from the voltage VGL to the voltage VGH, the gate control signal Gate_(n+1) may be the voltage VGL, and the gate control signal Gate_(n−1) and the gate control signal Gate_(n) may be the voltage VGL. The transistors T4, T6 and T7 are turned-on, and the transistor T1 is turned-off. Thus, the transistor T4 may change the voltage V_N1 of the circuit node N1 to the voltage VGL through the transistor T7, and then the transistor T2 is turned-off. The transistor T4 changes the voltage of the bias signal BS_n to the voltage VGL through the transistor T6 and the transistor T7 from the voltage VGH during the period from time t1 to time t2, so as to reset the bias signal BS_n. The circuit node NA may have the voltage VGL, so that, for example, the bias transistor Tb of FIG. 2 may be turned-off.

During the reset period RM of the pixel unit from time t4 to time t5, the gate control signal Gate_(n−1) transmitted by the gate line GL_(n−1) changes from the voltage VGL to the voltage VGH as the reset signal RS_n, and the voltage levels of the gate control signals Gate_(n−2), Gate_n and Gate_(n+1) maybe the voltage VGL. Thus, the pixel unit may receive the reset signal RS_n with the voltage VGH, and, for example, the bias transistor Tb of FIG. 2 may still be turned-off, and the reset transistor Tr is turned-on.

During the scan period SM of the pixel unit from time t6 to time t7, the gate control signal Gate_n transmitted by the gate line GL_n changes from the voltage VGL to the voltage VGH as the scan signal SS_n, and the voltage levels of the gate control signals Gate_(n−2), Gate_(n−1) and Gate_(n+1) may be the low voltage level. Thus, the pixel unit may receive the scan signal SS_n with the high voltage level, and, for example, the bias transistor Tb of FIG. 2 may still be turned-off, and the scan transistor Ts and the compensation transistor Tc are turned-on.

During the bias period BM of the pixel unit after time t8 or before time t1, the gate control signal Gate_(n+1) transmitted by the gate line GL_(n+1) changes from the voltage VGL to the voltage VGH, and the voltage levels of the gate control signals Gate_(n−2), Gate_n and Gate_(n+1) may be the voltage VGL during the period from time t8 to time t12. The transistors T1, T2, T6 and T7 are turned-on, and the transistor T4 is turned-off. The voltage of the refresh clock signal RCK_m may be the low voltage level VCKL. Thus, during the period from time t8 to time t9, the voltage V_N1 of the circuit node N1 may be first changed to the voltage of the voltage VGH minus the threshold voltage |Vth1| of the transistor T1 by the transistor T1 through the transistor T6. During the period from time t9 to time t10, due to the voltage of the refresh clock signal RCK_m is still the low voltage level VCKL, the voltage V_N1 of the circuit node N1 may be maintained at the voltage of the voltage VGH minus the threshold voltage |Vth1| of the transistor T1.

During the period from time t10 to time t11, if the voltage of the refresh clock signal RCK_m changes from the low voltage level VCKL to the high voltage level VCKH, the voltage V_N1 of the circuit node N1 may be changed by the refresh clock signal RCK_m through the capacitor C2 from the voltage of the voltage VGH minus the threshold voltage |Vth1| of the transistor T1 to the voltage of the voltage VGH minus the threshold voltage |Vth1| of the transistor T1 and plus a voltage dV. The voltage dV is determined by the capacitor C2, the voltage difference level of the high voltage level VCKH minus the low voltage level VCKL and the transistor T2. The transistor T6 and the transistor T7 may be cut-off by the voltage V_N1 when the voltage V_N1 of the circuit node N1 be continuously changed by the coupling of the capacitor C2 to over the voltage VGH. Then, the transistor T2 will be fully turned-on, and the voltage of the bias signal BS_n reaches to the voltage VGH. The circuit node NA may change to the voltage VGH, so that, for example, the bias transistor Tb of FIG. 2 may still be turned-on.

During the period from time t11 to time t13, due to the voltage of the refresh clock signal RCK_m maintains at the high voltage level VCKH, the voltage V_N1 of the circuit node N1 may also be maintained. Thus, the voltage of the bias signal BS_n reaches to the voltage VGH may also be maintained at the voltage VGH.

During a period from time t13 to time t14, due to the voltage of the refresh clock signal RCK_m is changed to the low voltage level VCKL, the voltage V_N1 of the circuit node N1 may drop back to the voltage of the voltage VGH minus the threshold voltage |Vth1| of the transistor T1 by the capacitive coupling of the capacitor C2, so that the transistor T2 is turned-off. Moreover, the voltage of the bias signal BS_n may be maintained at the voltage VGH because the stray (parasitic) capacitance Cs during the period from time t14 to time t15 and time t0 to time t1. Therefore, the bias control signal driver 820 may effectively provide the bias signal BS_n to the pixel units of n-th row of pixel array 101 of FIG. 1 according to the gate control signal Gate_(n+1) and the gate control signal Gate_(n−2). Thus, for example, the bias transistor Tb of FIG. 2 may receive the bias signal BS_n, and the voltage source circuit 242 may implement the compensation of the threshold voltage of the driving voltage for the driving electronic element 241 according to the bias signal BS, the scan signal SS and the reset signal RS.

Figure 10:
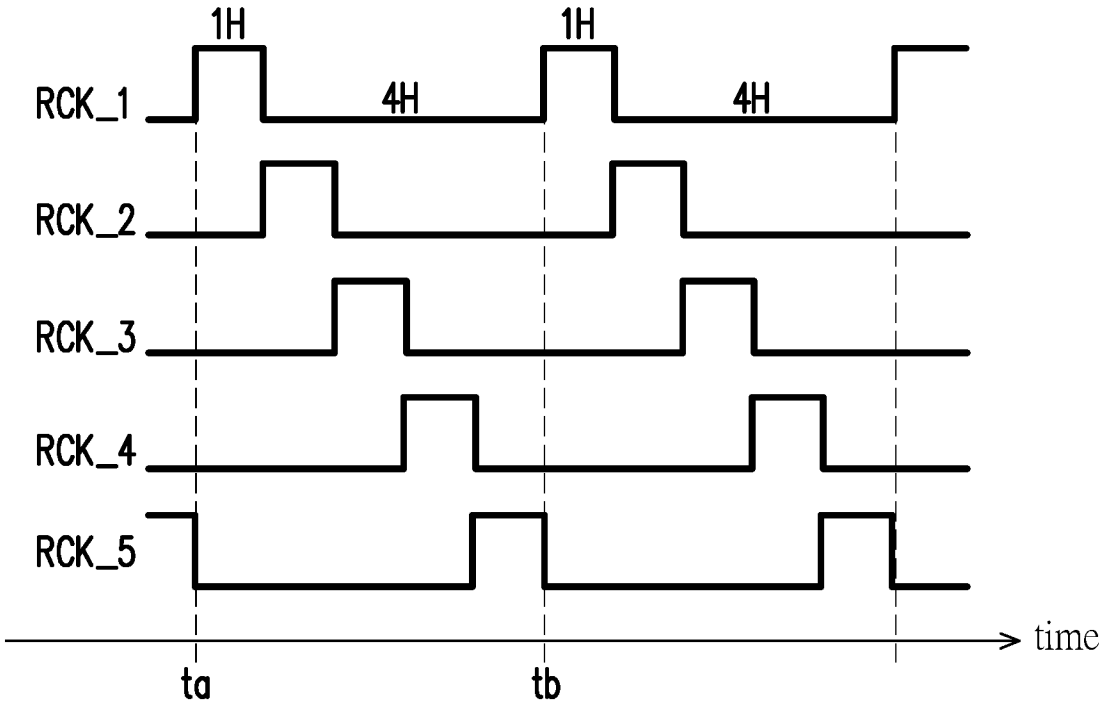
FIG. 10 is a timing diagram of a plurality of refresh clock signals according to the embodiment of the disclosure.

FIG. 10 is a timing diagram of a plurality of refresh clock signals according to the embodiment of the disclosure. Referring to FIG. 1, FIG. 8, FIG. 9 and FIG. 10, the waveform of the refresh clock signal RCK_m of FIG. 8 and FIG. 9 may continuously change periodically after time t15. Thus, just toggling the refresh clock signal RCK_m, the transistor T2 will be turned-on again, so as to refresh the voltage of the bias signal BS_n with the voltage VGH. In the embodiment of the disclosure, as shown in FIG. 9, the refresh clock signal RCK_m may be shared with every 5 rows. Therefore, as show in FIG. 10, for example, the bias control signal drivers of the electronic device 100 of FIG. 1 may electronically connected to five refresh clock signal lines and share the five refresh clock signals RCK_1 to RCK_5.

Figure 11:
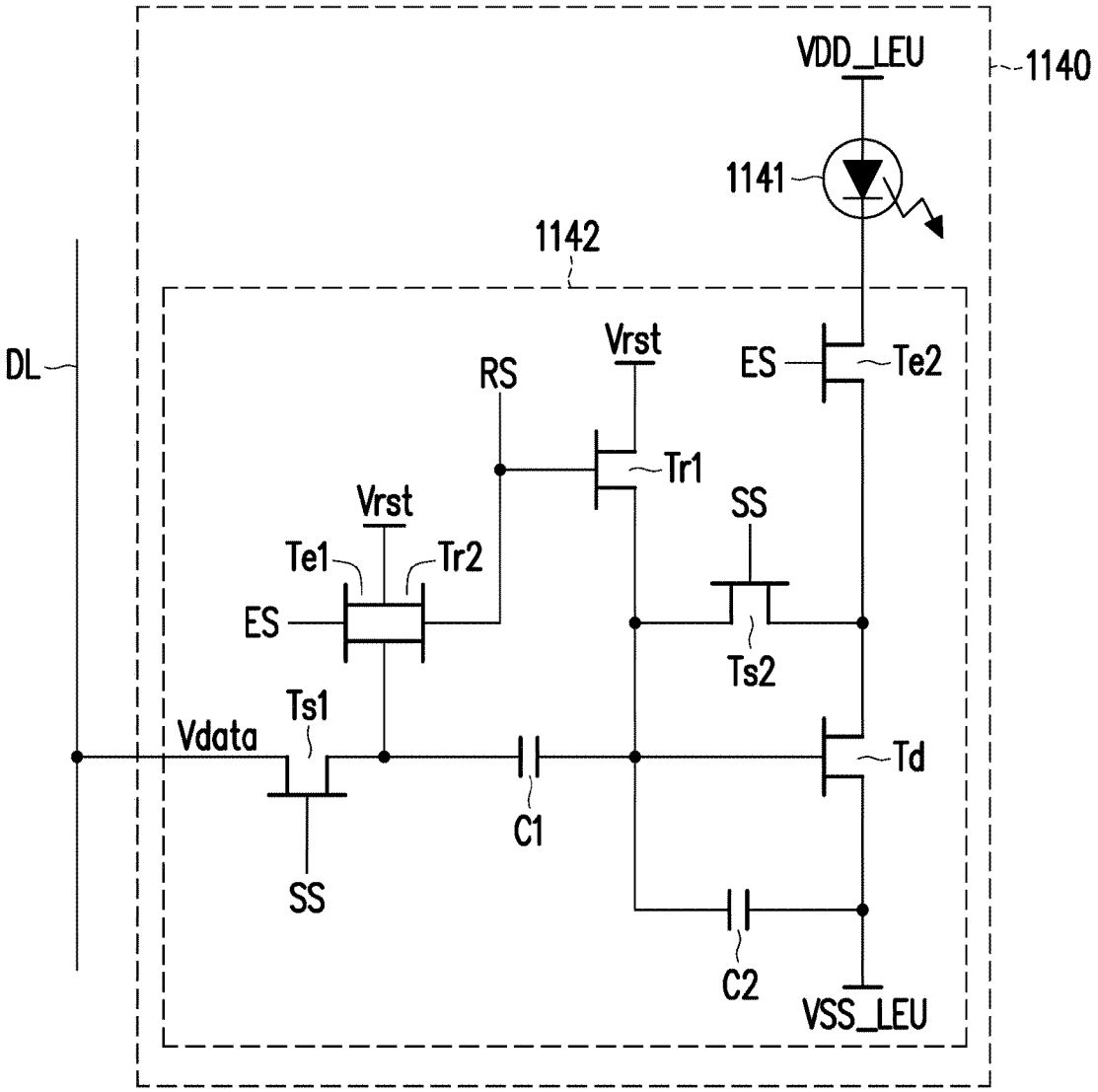
FIG. 11 is a circuit schematic diagram of a pixel unit according to another embodiment of the disclosure.

FIG. 11 is a circuit schematic diagram of a pixel unit according to another embodiment of the disclosure. Referring to FIG. 11, in a LED display application, the above-mentioned pixel unit may be implemented as a pixel unit 1140 of FIG. 11, and the above-mentioned bias control signal driver may be configured to generate the bias signals as an emission signals ES in FIG. 11. In the embodiment of the disclosure, the pixel unit 1140 includes a light emitting unit 1141 and a current source circuit 1142. The light emitting unit 1141 is electrically connected between a voltage VDD_LEU and the current source circuit 1142. The current source circuit 1142 includes a drive transistor Td, a first emission transistor Te1, a second emission transistor Te2, a first reset transistor Tr1, a second reset transistor Tr2, a first scan transistor Ts1, a second scan transistor Ts2, a capacitor C1 and a capacitor C2.

A first terminal of the scan transistor Ts1 is electrically connected to the data line DL to receive a data signal with the data voltage Vdata. A second terminal of the scan transistor Ts1 is electrically connected to the first emission transistor Te1, the second reset transistor Tr2 and the capacitor C1. A control terminal of the scan transistor Ts1 receives the scan signal SS. A first terminal of the first emission transistor Te1 is electrically connected to a reference voltage Vref. A second terminal of the first emission transistor Te1 is electrically connected to the second terminal of the first scan transistor Ts1 and the second reset transistor Tr2. A control terminal of the first emission transistor Te1 receives the emission signal ES. A first terminal of the second reset transistor Tr2 is electrically connected to the reference voltage Vref. A second terminal of the second reset transistor Tr2 is electrically connected to the second terminal of the first scan transistor Ts1, the first emission transistor Te1 and the capacitor C1. A control terminal of the second reset transistor Tr2 receives a reset signal RS.

A first terminal of the capacitor C1 is electrically connected to the second terminals of the first scan transistor Ts1, the first emission transistor Te1 and the second reset transistor Tr2. A second terminal of the capacitor C1 is electrically connected to the first reset transistor Tr, the second scan transistor Ts2, the drive transistor Td and the capacitor C2. A first terminal of the first reset transistor Tr1 is electrically connected to a reset voltage Vrst. A second terminal of the first reset transistor Tr1 is electrically connected the second scan transistor Ts2, the drive transistor Td, the capacitor C1 and the capacitor C2. A control terminal of the first reset transistor Tr1 receives the reset signal RS. A first terminal of the second scan transistor Ts2 is electrically connected to the second terminal of the first reset transistor Tr1, the drive transistor Td, the capacitor C1 and the capacitor C2. A second terminal of the second scan transistor Ts2 is electrically connected to the second emission transistor Te2 and the drive transistor Td. A control terminal of the second scan transistor Ts2 receives the scan signal SS.

A first terminal of the second emission transistor Te2 is electrically connected to the light emitting unit 1141. A second terminal of the second emission transistor Te2 is electrically connected to the second terminal of the second scan transistor Ts2 and the drive transistor Td. A control terminal of the second emission transistor Te2 receives the emission signal ES. A first terminal of the drive transistor Td is electrically connected to the second terminal of the second emission transistor Te2 and the second terminal of the second scan transistor Ts2. A second terminal of the drive transistor Td is electrically connected to the capacitor C2 and a voltage VSS_LEU. A control terminal of the drive transistor Td is electrically connected to the second terminal of the first reset transistor Tr1, the first terminal of the second scan transistor Ts2, the capacitor C1 and the capacitor C2. A first terminal of the capacitor C2 is electrically connected to the second terminal of the first reset transistor Tr1, the first terminal of the second scan transistor Ts2, the control terminal of the drive transistor Td and the capacitor C1. A second terminal of the capacitor C2 is electrically connected to the second terminal of the drive transistor Td and the voltage VSS_LEU.

In the embodiment of the disclosure, the first emission transistor Te1 and the second emission transistor Te2 may receive the bias signals provided by the above-mentioned bias control signal driver as the emission signals ES. The current source circuit 1142 may implement the compensation of the threshold voltage of the driving current for the driving light emitting unit 1141 according to the emission signal ES, the scan signal SS and the reset signal RS.

Figure 12:
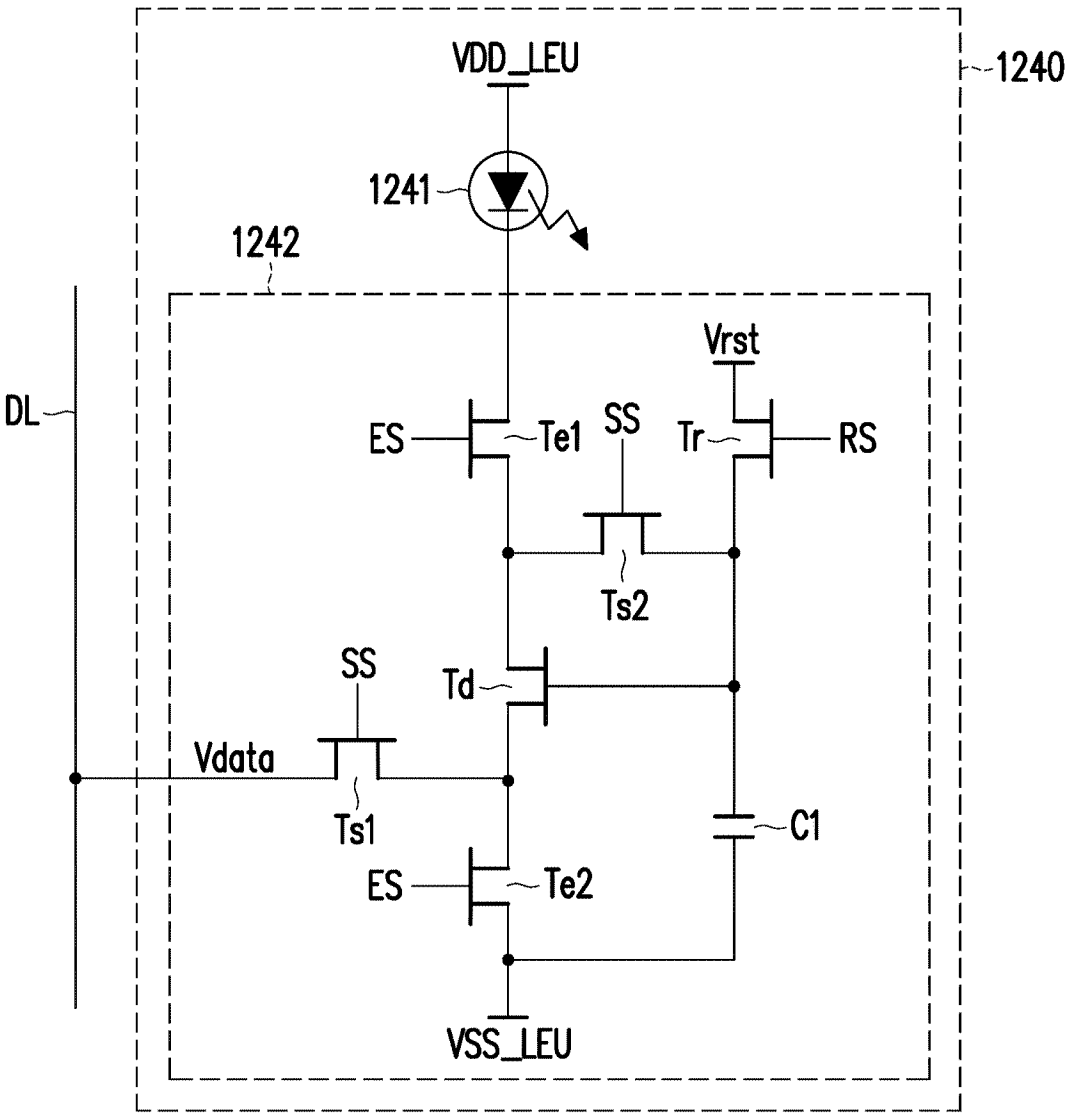
FIG. 12 is a circuit schematic diagram of a pixel unit according to yet another embodiment of the disclosure.

FIG. 12 is a circuit schematic diagram of a pixel unit according to yet another embodiment of the disclosure. Referring to FIG. 12, in a LED display application, the above-mentioned pixel unit may be implemented as a pixel unit 1240 of FIG. 12, and the above-mentioned bias control signal driver may be configured to generate the bias signals as an emission signals ES in FIG. 12. In the embodiment of the disclosure, the pixel unit 1240 includes a light emitting unit 1241 and a current source circuit 1242. The light emitting unit 1241 is electrically connected between a voltage VDD_LEU and the current source circuit 1242. The current source circuit 1142 includes a drive transistor Td, a first emission transistor Te1, a second emission transistor Te2, a reset transistor Tr, a first scan transistor Ts1, a second scan transistor Ts2 and a capacitor C1.

A first terminal of the scan transistor Ts1 is electrically connected to a data line DL to receive a data signal with a data voltage Vdata. A second terminal of the scan transistor Ts1 is electrically connected to the drive transistor Td and the second emission transistor Te2. A control terminal of the scan transistor Ts1 receives a scan signal SS. A first terminal of the first emission transistor Te1 is electrically connected to the light emitting unit 1241. A second terminal of the first emission transistor Te1 is electrically connected to the second scan transistor Ts2 and the drive transistor Td. A control terminal of the first emission transistor Te1 receives the emission signal ES.

A first terminal of the reset transistor Tr is electrically connected to a reset voltage Vrst. A second terminal of the reset transistor Tr is electrically connected to the second scan transistor Ts2, the driver transistor Td and the capacitor C1. A control terminal of the reset transistor Tr receives a reset signal RS. A first terminal of the second scan transistor Ts2 is electrically connected to the second terminal of the first emission transistor Te1 and the driver transistor Td. A second terminal of the second scan transistor Ts2 is electrically connected to the second terminal of the reset transistor Tr, the driver transistor Td and the capacitor C1. A control terminal of the second scan transistor Ts2 receives the scan signal SS.

A first terminal of the drive transistor Td is electrically connected to the second terminal of first emission transistor Te1 and the first terminal of the second scan transistor Ts2. A second terminal of the drive transistor Td is electrically connected to the second terminal of the first scan transistor Ts1 and the second emission transistor Te2. A control terminal of the drive transistor Td is electrically connected to the second terminal of the reset transistor Tr, the second terminal of the second scan transistor Ts2 and the capacitor C1.

A first terminal of the second emission transistor Te2 is electrically connected to the second terminal of first scan transistor Ts1 and the second terminal of the drive transistor Td. A second terminal of the second emission transistor Te2 is electrically connected to the capacitor C1 and a voltage VSS_LEU. A control terminal of the second emission transistor Te2 receives the emission signal ES. A first terminal of the capacitor C1 is electrically connected to the second terminal of the reset transistor Tr, the second terminal of the second scan transistor Ts2 and the drive transistor Td. A second terminal of the capacitor C1 is electrically connected to the second terminal of the second emission transistor Te2 and the voltage VSS_LEU.

In the embodiment of the disclosure, the first emission transistor Te1 and the second emission transistor Te2 may receive the bias signal provided by the above-mentioned bias control signal driver as the emission signal ES. The current source circuit 1242 may implement the compensation of the threshold voltage of the driving current for the driving light emitting unit 1241 according to the emission signal ES, the scan signal SS and the reset signal RS.

In summary, the electronic device of the disclosure may generate the bias signal to drive the pixel unit according to the part of the plurality of gate control signals without additionally disposing a complicated bias signal generation IC, and the pixel unit may receive the scan signal, the reset signal, and the bias signal to implement the compensation of the threshold voltage of the driving voltage and the driving current for the electronic element.

It will be apparent to those skilled in the art that various modifications and variations can be made to the disclosed embodiments without departing from the scope or spirit of the disclosure. In view of the foregoing, it is intended that the disclosure covers modifications and variations provided that they fall within the scope of the following claims and their equivalents.

What is claimed is:

1. An electronic device, comprising:

a pixel array, comprising a pixel unit, a gate driver, configured to generate a plurality of gate control signals; and a bias control signal driver, electrically connected to the pixel unit and the gate driver, and configured to generate a bias signal to drive the pixel unit according to a part of the plurality of gate control signals, wherein the bias control signal driver comprises a first transistor and a second transistor, wherein a first terminal of the first transistor receives a j-th gate control signal, a second terminal of the first transistor is electronically connected to a control terminal of the second transistor, a first terminal of the second transistor receives a high voltage and the bias control signal driver sets the high voltage of the bias signal by the control terminal of the second transistor receiving the j-th gate control signal.

2. The electronic device according to the claim 1, wherein the pixel unit comprises an electronic element.

3. The electronic device according to the claim 2, wherein the pixel unit further comprises a voltage source circuit electrically connected to the electronic element, and the electronic element is a voltage-controlled element.

4. The electronic device according to the claim 2, wherein the pixel unit further comprises a current source circuit electrically connected to the electronic element, and the electronic element is a current-controlled element.

5. The electronic device according to the claim 1, wherein an (n−1)-th gate control signal of the plurality of gate control signals is configured to reset a plurality of pixel units of an n-th row of the pixel array, wherein n is a positive integer.

6. The electronic device according to the claim 1, wherein an n-th gate control signal of the plurality of gate control signals is configured to set a data voltage for a plurality of pixel units of an n-th row of the pixel array, wherein n is a positive integer.

7. The electronic device according to the claim 1, wherein the bias control signal driver is configured to receive an i-th gate control signal and the j-th gate control signal, and drive a plurality of pixel units of an n-th row of the pixel array, wherein i, j and n are positive integers, wherein i is smaller than (n−1), and j is greater than n.

8. The electronic device according to the claim 7, wherein i is equal to (n−2).

9. The electronic device according to the claim 7, wherein j is equal to (n+1).

10. The electronic device according to the claim 7, wherein the bias control signal driver further comprises a first capacitor, and the first capacitor is electrically connected between the control terminal and a second terminal of the second transistor, wherein the bias control signal driver comprises a fourth transistor, wherein the fourth transistor receives the i-th gate control signal to set a low voltage level for the bias signal, wherein the bias control signal driver further comprises a fifth transistor, wherein the fifth transistor is electrically connected to the second transistor, and the fifth transistor receives the i-th gate control signal to set the low voltage level to the control terminal of the second transistor, wherein the bias control signal driver further comprises a sixth transistor, and the sixth transistor is coupled between the first transistor and the second transistor.

11. The electronic device according to the claim 7, wherein the bias control signal driver further comprises a second capacitor, and the second capacitor is electrically connected to the second transistor, wherein the second capacitor is configured to receive a refresh clock signal to boost the control terminal of the second transistor, wherein the bias control signal driver further comprises a third transistor, and the third transistor is electrically connected between the refresh clock signal and the second capacitor, wherein the bias control signal driver comprises a fourth transistor, wherein the fourth transistor receives the i-th gate control signal to set a low voltage level for the bias signal, wherein the bias control signal driver further comprises a sixth transistor, and the sixth transistor is coupled between the first transistor and the second transistor, wherein the bias control signal driver further comprises a seventh transistor, and the seventh transistor is coupled between the fourth transistor and the second transistor.

12. The electronic device according to the claim 7, wherein the bias control signal driver further comprises a second capacitor, and the second capacitor is electrically connected to the second transistor, wherein the second capacitor is configured to receive an m-th refresh clock signal to boost the control terminal of the second transistor, wherein the bias control signal driver comprises a fourth transistor, wherein the fourth transistor receives the i-th gate control signal to set a low voltage level for the bias signal, wherein the bias control signal driver further comprises a sixth transistor, and the sixth transistor is coupled between the first transistor and the second transistor, wherein the bias control signal driver further comprises a seventh transistor, and the seventh transistor is coupled between the fourth transistor and the second transistor.

* * * * *